US009053705B2

(12) United States Patent
Bessette

(10) Patent No.: US 9,053,705 B2
(45) **Date of Patent: *Jun. 9, 2015**

(54) FLEXIBLE AND SCALABLE COMBINED INNOVATION CODEBOOK FOR USE IN CELP CODER AND DECODER

(75) Inventor: Bruno Bessette, Sherbrooke (CA)

(73) Assignee: VOICEAGE CORPORATION, Town of Mount Royal, Quebec (CA)

( * ) Notice: Subject to any disclaimer, the term of this patent is extended or adjusted under 35 U.S.C. 154(b) by 605 days.

This patent is subject to a terminal disclaimer.

(21) Appl. No.: 13/083,900

(22) Filed: Apr. 11, 2011

(65) Prior Publication Data

US 2012/0089389 A1 Apr. 12, 2012

Related U.S. Application Data

(60) Provisional application No. 61/324,191, filed on Apr. 14, 2010.

(51) Int. Cl.

| | |
|---|---|
| ***G10L 19/00*** | (2013.01) |
| ***G10L 21/00*** | (2013.01) |
| ***G10L 19/12*** | (2013.01) |
| *G10L 19/02* | (2013.01) |
| *G10L 19/09* | (2013.01) |
| *G10L 19/24* | (2013.01) |

(52) U.S. Cl.

CPC ..... *G10L 19/12* (2013.01); *G10L 19/0212* (2013.01); *G10L 19/09* (2013.01); *G10L 19/24* (2013.01)

(58) Field of Classification Search

None

See application file for complete search history.

(56) References Cited

U.S. PATENT DOCUMENTS

| | | | | |
|---|---|---|---|---|
| 6,134,518 | A * | 10/2000 | Cohen et al. | 704/201 |
| 6,662,154 | B2 * | 12/2003 | Mittal et al. | 704/219 |
| 7,106,228 | B2 | 9/2006 | Bessette et al. | |
| 7,430,329 | B1 * | 9/2008 | Sarna | 382/239 |
| 7,996,233 | B2 * | 8/2011 | Oshikiri | 704/500 |
| 8,306,827 | B2 * | 11/2012 | Yamanashi et al. | 704/500 |
| 8,515,767 | B2 * | 8/2013 | Reznik | 704/500 |

(Continued)

FOREIGN PATENT DOCUMENTS

| | | |
|---|---|---|
| AU | 2001 255 422 | 12/2001 |
| CA | 2 347 735 | 5/2000 |

(Continued)

OTHER PUBLICATIONS

Yang et al., "*Transform-Based CELP Vocoders with Low-Delay Low-Complexity and Variable-Rate Features*", IEICE Trans. Inf. & Syst., vol. E85-D, No. 6, Jun. 2002, pp. 1003-1014.

(Continued)

*Primary Examiner* — Richemond Dorvil
*Assistant Examiner* — Thuykhanh Le
(74) *Attorney, Agent, or Firm* — Fay Kaplun & Marcin, LLP

(57) ABSTRACT

In a CELP coder, a combined innovation codebook coding device comprises a pre-quantizer of a first, adaptive-codebook excitation residual, and a CELP innovation-codebook search module responsive to a second excitation residual produced from the first, adaptive-codebook excitation residual. In a CELP decoder, a combined innovation codebook comprises a de-quantizer of pre-quantized coding parameters into a first excitation contribution, and a CELP innovation-codebook structure responsive to CELP innovation-codebook parameters to produce a second excitation contribution.

34 Claims, 4 Drawing Sheets

(56) References Cited

U.S. PATENT DOCUMENTS

| | | | | |
|---|---|---|---|---|
| 8,892,448 | B2 * | 11/2014 | Vos et al. | 704/500 |
| 8,892,449 | B2 * | 11/2014 | Lecomte et al. | 704/500 |
| 2002/0103638 | A1 * | 8/2002 | Gao | 704/207 |
| 2003/0097258 | A1 * | 5/2003 | Thyssen | 704/222 |
| 2005/0096903 | A1 * | 5/2005 | Mittal et al. | 704/226 |
| 2005/0240398 | A1 * | 10/2005 | Chen et al. | 704/222 |
| 2006/0247926 | A1 * | 11/2006 | Rousseau | 704/219 |
| 2006/0271356 | A1 * | 11/2006 | Vos | 704/222 |
| 2008/0120118 | A1 * | 5/2008 | Choo et al. | 704/500 |
| 2008/0126085 | A1 * | 5/2008 | Morii | 704/222 |
| 2009/0182558 | A1 * | 7/2009 | Su et al. | 704/230 |
| 2009/0240491 | A1 * | 9/2009 | Reznik | 704/219 |
| 2010/0017198 | A1 | 1/2010 | Yamanashi et al. | |
| 2010/0324917 | A1 * | 12/2010 | Shlomot et al. | 704/501 |
| 2010/0332221 | A1 * | 12/2010 | Yamanashi et al. | 704/207 |
| 2011/0010169 | A1 * | 1/2011 | Vasilache et al. | 704/222 |

FOREIGN PATENT DOCUMENTS

| | | |
|---|---|---|
| EP | 0 665 530 | 8/1995 |
| FR | 2 292 466 | 10/2009 |
| RU | 2 223 555 | 5/2003 |
| WO | 2009/059333 | 5/2009 |
| WO | WO 2009113316 A1 * | 9/2009 |

OTHER PUBLICATIONS

Bessette et al., "*Proposed CE for extending the LPD Mode in USAC*", 94 MPEG Meeting; 11-10-2010-10-15-2010; Guangzhou; Motion Picture Expert Group or ISO/IEC JTC1/sc29/wg11, No. M18481, Oct. 8, 2010, XP030047071,4 pps.

* cited by examiner

FLEXIBLE AND SCALABLE COMBINED INNOVATION CODEBOOK FOR USE IN CELP CODER AND DECODER

PRIORITY CLAIM

The present application claims the priority to the U.S. Provisional Application Ser. No. 61/324,191, entitled "Flexible And Scalable Combined Innovation Codebook For Use In CELP Coder And Decoder" filed on Apr. 14, 2010. The specification of the above-identified application is incorporated herewith by reference.

FIELD

The present invention relates to combined innovation codebook devices and corresponding methods for use in a Code-Excited Linear Prediction (CELP) coder and decoder.

BACKGROUND

The CELP model is widely used to encode sound signals, for example speech, at low bit rates. In CELP, the sound signal is modelled as an excitation processed through a time-varying synthesis filter. Although the time-varying synthesis filter may take many forms, a linear recursive all-pole filter is often used. The inverse of this time-varying synthesis filter, which is thus a linear all-zero non-recursive filter, is called "Short-Term Prediction" (STP) filter since it comprises coefficients calculated in such a manner as to minimize a prediction error between a sample s[i] of the sound signal and a weighted sum of previous samples s[i-1], s[i-2], . . . , s[i-m] of the sound signal, where m is the order of the filter. Another denomination frequently used for the STP filter is "Linear Prediction" (LP) filter.

If a residual of the prediction error from the LP filter is applied as the input of the time-varying synthesis filter with proper initial state, the output of the synthesis filter is the original sound signal, such as speech. At low bit rates, it is not possible to transmit an exact prediction error residual. Accordingly, the prediction error residual is encoded to form an approximation referred to as the excitation. In traditional CELP coders, the excitation is encoded as the sum of two contributions; the first contribution is produced from a so-called adaptive codebook and the second contribution is produced from a so-called innovation or fixed codebook. The adaptive codebook is essentially a block of samples from the past excitation with proper gain. The innovation or fixed codebook is populated with codevectors having the task of encoding the prediction error residual from the LP filter and adaptive codebook.

The innovation or fixed codebook can be designed using many structures and constraints. However, in modern speech coding systems, the Algebraic Code-Excited Linear Prediction (ACELP) model is often used. ACELP is well known to those of ordinary skill in the art of speech coding and, accordingly, will not be described in detail in the present specification. In summary, the codevectors in an ACELP innovation codebook each contain few non-zero pulses which can be seen as belonging to different interleaved tracks of pulse positions. The number of tracks and non-zero pulses per track usually depend on the bit rate of the ACELP innovation codebook. The task of an ACELP coder is to search the pulse positions and signs to minimize an error criterion. In ACELP, this search is performed using an analysis-by-synthesis procedure in which the error criterion is calculated not in the excitation domain but rather in the synthesis domain, i.e. after a given ACELP codevector has been filtered through the time-varying synthesis filter. Efficient ACELP search algorithms have been proposed to allow fast search even with very large ACELP innovation codebooks.

FIG. 1 is a schematic block diagram showing the main components and the principle of operation of an ACELP decoder 100. Referring to FIG. 1 the ACELP decoder 100 receives decoded pitch parameters 101 and decoded ACELP parameters 102. The decoded pitch parameters 101 include a pitch delay applied to the adaptive codebook 103 to produce an adaptive codevector. As indicated hereinabove, the adaptive codebook 103 is essentially a block of samples from the past excitation and the adaptive codevector is found by interpolating the past excitation at the pitch delay using an equation including the past excitation. The decoded pitch parameters also include a pitch gain applied to the adaptive codevector from the adaptive codebook 103 using an amplifier 112 to form the first, adaptive codebook contribution 113. The adaptive codebook 103 and the amplifier 112 form an adaptive codebook structure. The decoded ACELP parameters comprise ACELP innovation-codebook parameters including a codebook index applied to the innovation codebook 104 to output a corresponding innovation codevector. The decoded ACELP parameters also comprise an innovation codebook gain applied to the innovation codevector from the codebook 104 by means of an amplifier 105 to form the second, innovation codebook contribution 114. The innovation codebook 104 and the amplifier 105 form an innovation codebook structure 110. The total excitation 115 is then formed through summation in an adder 106 of the first, adaptive codebook contribution 113 and the second, innovation codebook contribution 114. The total excitation 115 is then processed through a LP synthesis filter 107 to produce a synthesis 111 of the original sound signal, for example speech. The memory of the adaptive codebook 103 is updated for a next frame using the excitation of the current frame (arrow 108); the adaptive codebook 103 then shifts to processing the decoded pitch parameters of the next subframe (arrow 109). Several modifications can be made to the basic CELP model previously described. For example the excitation signal at the input of the synthesis filer can be processed to enhance the signal. Also postprocessing can be applied at the output of the synthesis filter. Further, the gains of the adaptive and algebraic codebooks can be jointly quantized.

Although very efficient to encode speech at low bit rates, ACELP codebooks may not gain in quality as quickly as other approaches such as transform coding and vector quantization when increasing the ACELP codebook size. When measured in dB/bit/sample, the gain at higher bit rates (e.g. bit rates higher than 16 kbit/s) obtained by using more non-zero pulses per track in an ACELP innovation codebook is not as large as the gain (in dB/bit/sample) of transform coding and vector quantization. This can be seen when considering that ACELP essentially encodes the sound signal as a sum of delayed and scaled impulse responses of the synthesis filter. At lower bit rates (e.g. bit rates lower than 12 kbit/s), the ACELP technique captures quickly the essential components of the excitation. But at higher bit rates, higher granularity and, in particular, a better control over how the additional bits are spent across the different frequency components of the signal are useful.

Therefore, there is a need for an innovation codebook structure better adapted for use at higher bit rates.

DETAILED DESCRIPTION

According to non-limitative exemplary aspects, the present disclosure relates to:

a combined innovation codebook coding method, comprising: pre-quantizing a first, adaptive-codebook excitation residual, the pre-quantizing being performed in transform-domain; and searching a CELP innovation-codebook in response to a second excitation residual produced from the first, adaptive-codebook excitation residual;

a combined innovation codebook decoding method comprising: de-quantizing pre-quantized coding parameters into a first innovation excitation contribution, wherein de-quantizing the pre-quantized coding parameters comprises calculating an inverse transform of the coding parameters; and applying CELP innovation-codebook parameters to a CELP innovation-codebook structure to produce a second innovation excitation contribution;

a combined innovation codebook coding device, comprising: a pre-quantizer of a first, adaptive-codebook excitation residual, the pre-quantizer operating in transform-domain; and a CELP innovation-codebook module responsive to a second excitation residual produced from the first, adaptive-codebook excitation residual;

a CELP coder comprising the above-mentioned combined innovation codebook coding device;

a combined innovation codebook comprising: a de-quantizer of pre-quantized coding parameters into a first innovation excitation contribution, the de-quantizer comprising an inverse transform calculator responsive to the coding parameters; and a CELP innovation-codebook structure responsive to CELP innovation-codebook parameters to produce a second innovation excitation contribution; and a CELP decoder comprising the above described combined innovation codebook.

The foregoing and other features of the combined innovation codebook devices and corresponding methods will become more apparent upon reading of the following non-restrictive description of illustrative embodiments thereof, given by way of example only with reference to the accompanying drawings.

Figure 1:
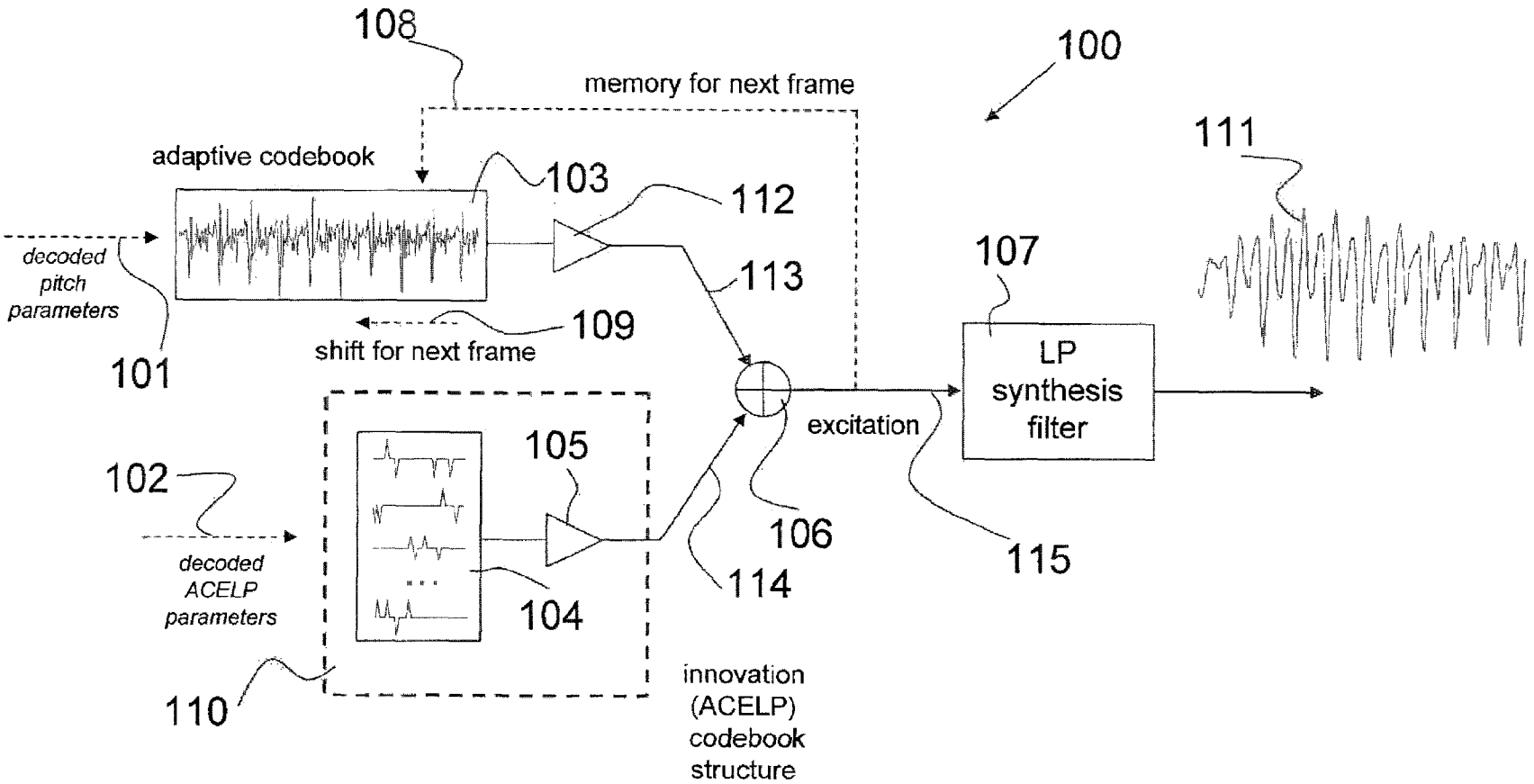
FIG. 1 is a schematic block diagram of a CELP decoder comprising adaptive and innovation codebook structures and using, in this non-limitative example, ACELP.
Figure 2:
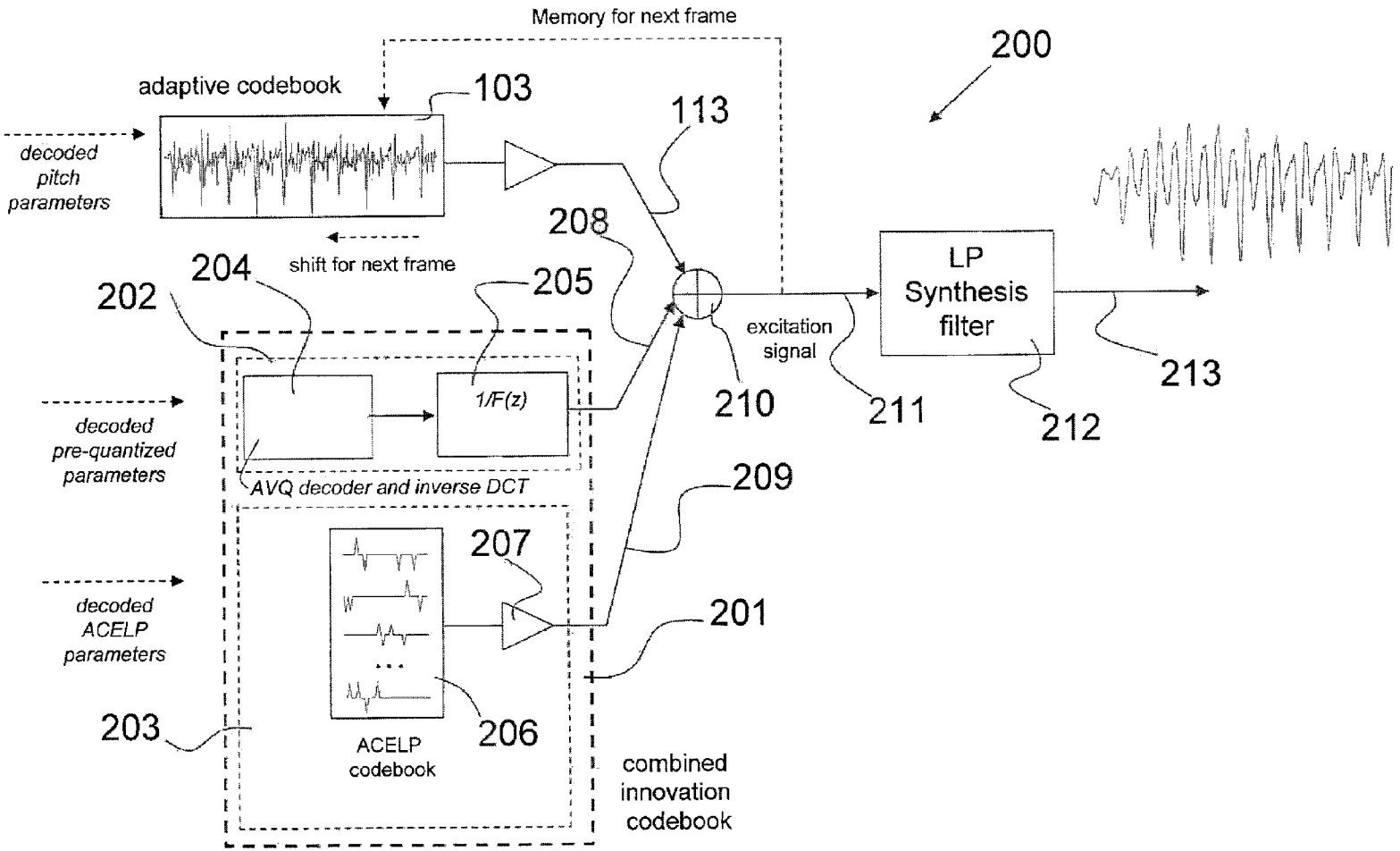
FIG. 2 is a schematic block diagram of a CELP decoder comprising a combined innovation codebook formed by a first decoding stage operating in the frequency domain and a second decoding stage operating in the time-domain using, for example, an ACELP innovation codebook.

Referring to the decoder 200 of FIG. 2, a CELP innovation codebook structure, for example the ACELP innovation codebook structure 110 of FIG. 1, is modified such that the advantages and coding efficiency of ACELP are retained at lower bit rates while providing better performance and scalability at higher bit rates. Of course, a CELP model other than ACELP could be used.

More specifically, FIG. 2 shows a flexible and scalable "combined innovation codebook" 201 resulting from the modification of the ACELP innovation codebook structure 110 of FIG. 1. As illustrated, the combined innovation codebook 201 comprises a combination of two stages: a first decoding stage 202 operating in transform-domain and a second decoding stage 203 using a time-domain ACELP codebook.

Prior to further describing the decoder 200 of FIG. 2, the ACELP coder 300 will be described in part with reference to FIG. 3.

Linear Prediction Filtering

Figure 3:
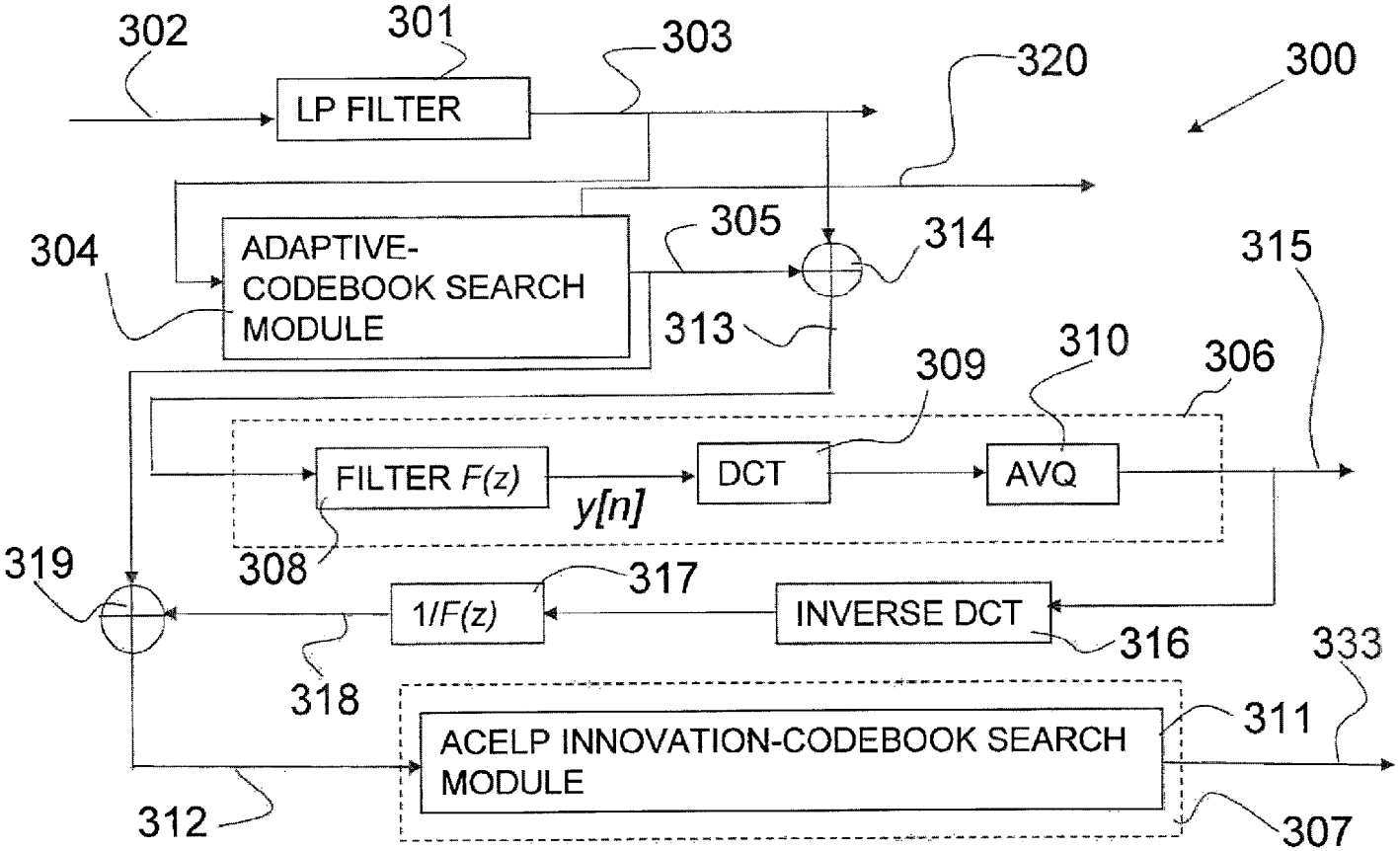
FIG. 3 is a schematic block diagram of a portion of a CELP coder using a combined innovation codebook coding device.

Referring to FIG. 3, the ACELP coder 300 comprises a LP filter 301 processing the input sound signal 302 to be coded. The LP filter 301 may present, for example, in the z-transform the following transfer function:

$$A(z) = \sum_{i=0}^{M} a_i z^{-i}$$

where $a_i$ represent the linear prediction coefficients (LP coefficients) with $a_0=1$, and M is the number of linear prediction coefficients (order of LP analysis). The LP coefficients $a_i$ are determined in an LP analyzer (not shown) of the ACELP coder 300.

The LP filter 301 produces at its output a LP residual 303.

Adaptive-Codebook Search

The LP residual signal 303 from the LP filter 301 is used in an adaptive-codebook search module 304 of the ACELP coder 300 to find an adaptive-codebook contribution 305. The adaptive-codebook search module 304 also produce the pitch parameters 320 transmitted to the decoder 200 (FIG. 2), including the pitch delay and the pitch gain. The adaptive codebook search also known as closed-loop pitch search usually includes computation of a so-called target signal and finding the parameters by minimizing the error between the original and synthesis signal in a perceptually weighted domain. Adaptive-codebook search of an ACELP coder is believed to be otherwise well known to those of ordinary skill in the art and, accordingly, will not be further described in the present specification.

The ACELP coder 300 also comprises a combined innovation codebook coding device including a first coding stage 306 operating in the transform-domain and referred to as pre-quantizer, and a second coding stage 307 operating in the time-domain and using, for example, ACELP. As illustrated in FIG. 3 in an illustrative embodiment, the first stage or pre-quantizer 306 comprises a pre-emphasis filter F(z) 308 which emphasizes the low frequencies, a Discrete Cosine Transform (DCT) calculator 309 and an Algebraic Vector Quantizer (AVQ) 310 (which includes an AVQ global gain). The second stage 307 comprises an ACELP innovation-codebook search module 311. It should be noted that the use of DCT and AVQ are examples only; other transforms can be used and other methods to quantize the transform coefficients can also be used.

As described hereinabove, the pre-quantizer 306 may use, for example, a DCT as frequency representation of the sound signal and an Algebraic Vector Quantizer (AVQ) to quantize and encode the frequency-domain coefficients of the DCT. The pre-quantizer 306 is used more as a pre-conditioning stage rather than a first-stage quantizer, especially at lower bit rates. More specifically, using the pre-quantizer 306, the ACELP innovation-codebook search module 311 (second coding stage 307) is applied to a second excitation residual 312 (FIG. 3) with more regular spectral dynamics than a first, adaptive-codebook excitation residual 313. In that sense, the pre-quantizer 306 absorbs the large signal dynamics in time and frequency, due in part to the imperfect work of the adaptive-codebook search, and leaves to the ACELP innovation-codebook search the task to minimize the coding error in the LP weighted domain (in a typical analysis-by-synthesis loop performed at the ACELP coder 300 and well known to those of ordinary skill in the art of speech coding).

Production of the Pitch Residual Signal 313

The ACELP coder 300 comprises a subtractor 314 for subtracting the adaptive-codebook contribution 305 from the LP residual signal 303 to produce the above-mentioned first, adaptive-codebook excitation residual 313 that is inputted to the pre-quantizer 306. The adaptive codebook excitation residual $r_1[n]$ is given by $$r_1[n]=r[n]-g_p v[n]$$

where r[n] is the LP residual, $g_p$ is the adaptive codebook gain, and v[n] is the adaptive codebook excitation (usually interpolated past excitation).

Pre-Quantizing

Operation of the pre-quantizer 306 will now be described with reference to FIG. 3.

Pre-Emphasis Filtering

Figure 4:
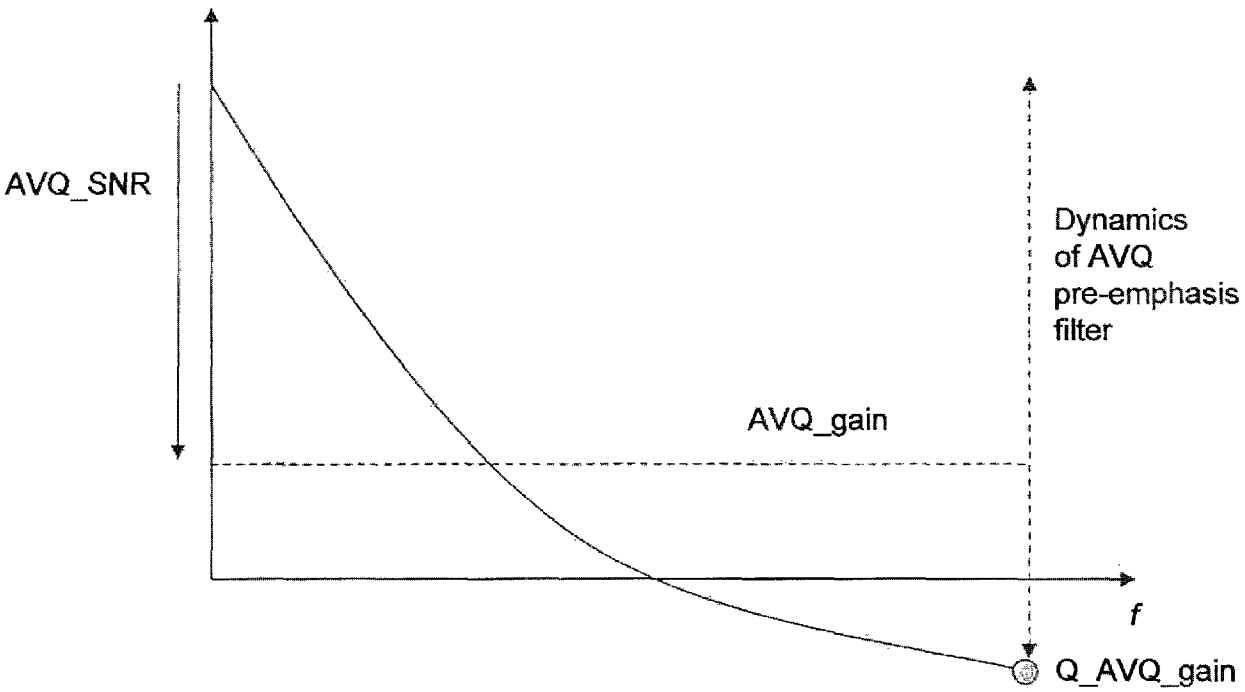
FIG. 4 is a graph showing an example of frequency response for a pre-emphasis filter F(z), wherein the dynamics of the pre-emphasis filter are shown as the difference (in dB) between the smallest and largest amplitudes of the frequency response.

In a given subframe aligned with the subframe of the ACELP innovation-codebook search in the second coding stage 307, the first, adaptive-codebook excitation residual 313 (FIG. 3) is pre-emphasized with a pre-emphasis filter F(z) 308. FIG. 4 shows an example of frequency response of the pre-emphasis filter F(z) 308, wherein the dynamics of the pre-emphasis filter are shown as the difference (in dB) between the smallest and largest amplitudes of the frequency response. An example pre-emphasis filter F(z) is given by $$F(z)=1/(1-\alpha z^{-1})$$

which corresponds to the difference equation $$y[n]=x[n]+\alpha y[n-1]$$

where x[n] is the first, adaptive-codebook excitation residual 313 inputted to the pre-emphasis filter F(z) 308, y[n] is the pre-emphasized, first adaptive-codebook excitation residual, and coefficient α controls a level of pre-emphasis. In this non limitative example, if the value of α is set between 0 and 1, the pre-emphasis filter F(z) 308 will have a larger gain in lower frequencies and a lower gain in higher frequencies, which will produce a pre-emphasized, first adaptive-codebook excitation residual y[n] with amplified lower frequencies. The pre-emphasis filter F(z) 308 applies a spectral tilt to the first, adaptive-codebook excitation residual 313 to enhance lower frequencies of this residual.

DCT Calculation

A calculator 309 applies, for example, a DCT to the pre-emphasized first, adaptive-codebook excitation residual y[n] from the pre-emphasis filter F(z) 308 using, for example, a rectangular non-overlapping window. In this non-limitative example, DCT-II is used, which is defined as $$Y[k]=\sum_{n=0}^{N-1} y[n]\cos\left[\frac{\pi}{N}(n+0.5)k\right]$$

Algebraic Vector Quantizing (AVQ)

A quantizer, for example the AVQ 310 quantizes and codes the frequency-domain coefficients of the DCT Y[k] (DCT-transformed, de-emphasised first adaptive-codebook excitation residual) from the calculator 309. An example of AVQ implementation can be found in U.S. Pat. No. 7,106,228. The quantized and coded frequency-domain DCT coefficients 315 from the AVQ 310 are transmitted as pre-quantized parameters to the decoder (FIG. 2). For example, the AVQ 310 may produce a global gain and scaled quantized DCT coefficients as pre-quantized parameters.

Depending on the bit rate, a target signal-to-noise ratio (SNR) for the AVQ 310 (AVQ_SNR (FIG. 4)) is set. The higher the bit rate, the higher this SNR is set. The global gain of the AVQ 310 is then set such that only blocks of DCT coefficients with an average amplitude greater than spectral_max−AVQ_SNR will be quantized, where spectral_max is the maximum amplitude of the frequency response of the pre-emphasis filter F(z) 308. The other non-quantized DCT coefficients are set to 0. In another approach, the number of quantized blocks of DCT coefficients depend on the bit rate budget; for example, the AVQ may encode transform coefficients related to lower frequencies only, depending on the available bit-budget.

Producing Excitation Residual Signal 312

Inverse DCT Calculation

To obtain the excitation residual signal 312 for the second coding stage 307

(ACELP innovation-codebook search in this example; other CELP structure could also be used), the AVQ-quantized DCT coefficients 315 from the AVQ 310 are inverse DCT transformed in calculator 316.

De-Emphasis Filtering

Then the inverse DCT transformed coefficients 315 are processed through a de-emphasis filter 1/F(z) 317 to obtain a time-domain contribution 318 from the pre-quantizer 306. The de-emphasis filter 1/F(z) 317 has the inverse transfer function of the pre-emphasis filter F(z) 308. In the non limitative example for the pre-emphasis filter F(z) 308 given herein above, the difference equation of the de-emphasis filter $1/F(z)=1-\alpha z^{-1}$ is given by:

$$y[n]=x[n]-\alpha x[n-1]$$

where, in the case of the de-emphasis filter, x[n] is the pre-emphasized quantized excitation residual (from calculator 316), y[n] is the de-emphasized quantized excitation residual (time-domain contribution 318), and coefficient α has been defined hereinabove.

Subtraction to Produce the Second Excitation Residual

Finally, a subtractor 319 subtracts the de-emphasized excitation residual y[n] (time-domain contribution 318) from the adaptive-codebook contribution 305 found by means of the adaptive-codebook search in the current subframe to yield the second excitation residual 312.

ACELP Innovation-Codebook Search

The Second Excitation Residual 312 is Encoded by the ACELP Innovation-codebook search module 311 in the second coding stage 307. Innovation-codebook search of an ACELP coder are believed to be otherwise well known to those of ordinary skill in the art and, accordingly, will not be further described in the present specification. The ACELP innovation-codebook parameters 333 at the output of the ACELP innovation-codebook search calculator 311 are transmitted as ACELP parameters to the decoder (FIG. 2). The encoding parameters 333 comprise an innovation codebook index and an innovation codebook gain.

Operation of the Combined Innovation Codebook 201

Referring back to the decoder 200 of FIG. 2, the first decoding stage of the combined innovation codebook 201, referred to as de-quantizer 202, comprises an AVQ decoder and an inverse DCT calculator 204, and an inverse filter 1/F(z) 205, corresponding to filter 317 of the coder 300 of FIG. 3. The contribution from the de-quantizer 202 is obtained as follows.

AVQ Decoding

First of all, the transform-domain decoder (204), AVQ in this example, (204) receives decoded pre-quantized coding parameters for example formed by the AVQ-quantized DCT coefficients 315 (which may include the AVQ global gain) from the AVQ 310 of FIG. 3. More specifically, the AVQ decoder de-quantizes the decoded pre-quantized coding parameters received by the decoder 200.

Inverse DCT Calculating

The inverse DCT calculator (204) then applies an inverse transform, for example the inverse DCT, to the de-quantized and scaled parameters from the AVQ decoder Y'[k]. Inverse DCT-II is used in this non-limitative example, defined as $$y'[n] = \frac{2}{N}\left\{0.5Y'[0] + \sum_{k=1}^{N-1} Y'[k]\cos\left[\frac{\pi}{N}(n+0.5)k\right]\right\}$$

De-Emphasis Filtering (1/F(z))

The AVQ-decoded and inverse DCT-transformed parameters y'[n] from the decoder/calculator 204 are then processed through the de-emphasis filter 1/F(z) 205 to produce a first stage innovation excitation contribution 208 from the de-quantizer 202.

ACELP Parameters Decoding

Coding in the ACELP innovation-codebook search calculator 311 of FIG. 3 (second coding stage 307) may also incorporate a tilt filter (not shown) which can be, but not necessarily controlled by the information from the DCT calculator 309 and the AVQ 310 of the first coding stage 306. In the decoder 200 of FIG. 2, decoded ACELP parameters are received by the second decoding stage 203. The decoded ACELP parameter comprises the ACELP innovation-codebook parameters 313 at the output of the ACELP innovation-codebook search calculator 311, which are transmitted to the decoder (FIG. 2) and comprise an innovation codebook index and an innovation codebook gain. The second decoding stage of the combined innovation codebook 201 of FIG. 2 comprises an ACELP codebook 206 responsive to the innovation codebook index to produce a codevector amplified by the innovation codebook gain using amplifier 207. A second ACELP innovation-codebook excitation contribution 209 is produced at the output of the amplifier 207. This ACELP innovation-codebook excitation contribution 209 is processed through the inverse of the above mentioned tilt filter in case it is incorporated at the coder (not shown), in the same manner as in the de-quantizer 202 in relation of inverse filter 1/F(z) 205. The tilt filter being used can be the same as filter F(z) but in general it will be different from F(z).

Addition of Excitation Contributions

Finally, the decoder 200 comprises an adder 210 to sum the adaptive codebook contribution 113, the excitation contribution 208 from the de-quantizer 202 and the ACELP innovation-codebook excitation contribution 209 to form a total excitation signal 211.

Synthesis Filtering

The excitation signal 211 is processed through an LP synthesis filter 212 to recover the sound signal 213.

Referring to FIG. 3, DCT calculator 309 and AVQ 310 of the pre-quantizer 306 concentrates on coding parts of the excitation residual spectrum that exceed a given threshold in dynamics. It does not aim at whitening the second excitation residual 312 for the second coding stage 307 as would be the case in a typical two-stage quantizer. Therefore, at the coder 300, the second excitation residual 312 that is encoded by the second stage 307 (ACELP innovation-codebook search module 311) is an excitation residual with controlled spectral dynamics, with the "excess" spectral dynamics being in a way absorbed by the pre-quantizer 306 in the first coding stage. As the bit rate increases, both the AVQ_SNR (FIG. 4) and number of quantized DCT blocks, starting from the DC component, increase in the first stage. In another example, the number of quantized DCT blocks depends on the available bit rate budget.

However, the higher the bit rate, the more bits are used, in proportion, by the pre-quantizer 306 in the first coding stage, which results in a total coding noise being shaped more and more to follow the spectral envelope of the weighted LP filter.

Although the present invention has been described in the foregoing description in relation to illustrative embodiments thereof, these embodiments can be modified at will within the scope of the appended claims without departing from the scope and nature of the present invention.

What is claimed is:

1. A Code-Excited Linear Prediction (CELP) codebook coding device for encoding sound into first, second, and third sets of encoding parameters, comprising:

at least one processor a memory coupled to the processor and embodying instructions which cause the processor to implement:

a Linear Prediction (LP) filter for processing an input sound signal and producing a first LP residual;

an adaptive-codebook search module adapted to, in response to the first LP residual, find an adaptive-codebook contribution and produce pitch parameters forming the first set of encoding parameters;

a first subtractor for producing a second, adaptive-codebook excitation residual by subtracting the adaptive-code book contribution from the first LP residual;

a pre-quantizer including a calculator of a transform of the second, adaptive-codebook excitation residual to produce quantized transform coefficients forming the second set of encoding parameters;

a second subtractor for producing a third excitation residual by subtracting an inverse-transformed version of the quantized transform coefficients from the adaptive-codebook contribution; and a CELP innovation-codebook search module adapted to, in response to the third excitation residual, find an innovation-codebook contribution and produce innovation codebook parameters forming the third set of encoding parameters.

2. A CELP codebook coding device as defined in claim 1, wherein the transform calculator of the pre-quantizer is a calculator of a Discrete Cosine Transform (DCT) of the second residual to produce DCT coefficients.

3. A CELP codebook coding device as defined in claim 1, wherein the transform calculator produces transform coefficients, and the pre-quantizer comprises a quantizer of the transform coefficients to produce the quantized transform coefficients.

4. A CELP codebook coding device as defined in claim 3, wherein the quantizer of the pre-quantizer is an algebraic vector quantizer to produce, in response to the transform coefficients from the transform calculator, algebraic-vector-quantized transform coefficients.

5. A combined innovation codebook coding device as defined in claim 3, wherein the quantizer encodes transform coefficients related to lower frequencies only, depending on an available bit-budget.

6. A CELP codebook coding device as defined in claim 1, wherein the pre-quantizer comprises a pre-emphasis filter of the second, adaptive-codebook excitation residual to produce a pre-emphasized second residual prior to calculating the transform.

7. A CELP codebook coding device as defined in claim 6, wherein the pre-emphasis filter emphasizes low frequencies of the second, adaptive-codebook excitation residual.

8. A CELP codebook coding device as defined in claim 6, comprising a calculator of an inverse transform of the quantized transform coefficients, and a de-emphasis filter of the inverse-transformed coefficients to produce a time-domain contribution forming the inverse-transformed version of the quantized transform coefficients, and wherein the second subtractor subtracts the time-domain contribution from the adaptive-codebook contribution to produce the third residual.

9. A CELP codebook coding device as defined in claim 1, wherein the CELP innovation-codebook search module is an Algebraic CELP (ACELP) innovation-codebook search module.

10. A CELP codebook coding device as defined in claim 1, wherein the pre-quantizer quantizes only transform coefficients having an energy exceeding a specified threshold, so that spectral dynamics of the third residual are reduced or maintained within a desired range.

11. A CELP coder comprising the Code-Excited Linear Prediction (CELP) codebook coding device as defined in claim 1.

12. A Code-Excited Linear Prediction (CELP) codebook decoding device for decoding sound in response to pitch parameters, pre-quantized coding parameters and innovation-codebook parameters, comprising:

at least one processor a memory coupled to the processor and embodying instructions which cause the processor to implement:

an adaptive codebook structure for producing an adaptive codebook contribution in response to the pitch parameters;

a de-quantizer of the pre-quantized coding parameters into a first innovation excitation contribution, the de-quantizer comprising an inverse transform calculator responsive to the coding parameters;

a CELP innovation-codebook structure responsive to the innovation-codebook parameters to produce a second innovation excitation contribution;

an adder of the adaptive codebook contribution, the first innovation excitation contribution and the second innovation excitation contribution to form a total excitation signal; and a Linear Prediction (LP) synthesis filter for processing the total excitation signal and producing a synthesis signal representing a synthesis of said sound.

13. A CELP codebook decoding device as defined in claim 12, wherein the de-quantizer comprises a decoder for de-quantizing the pre-quantized coding parameters.

14. A CELP codebook decoding device as defined in claim 13, wherein the decoder comprises an Algebraic Vector Quantizer (AVQ) decoder.

15. A CELP codebook decoding device as defined in claim 13, wherein the inverse transform calculator is responsive to the de-quantized coding parameters.

16. A CELP codebook decoding device as defined in claim 15, wherein the inverse transform is an inverse Discrete Cosine Transform (DCT).

17. A CELP codebook decoding device as defined in claim 13, wherein the de-quantizer comprises a de-emphasis filter supplied with the inverse-transformed, de-quantized coding parameters to produce the first innovation excitation contribution.

18. A CELP decoder comprising the Code-Excited Linear Prediction (CELP) codebook decoding device according to claim 12.

19. A Code-Excited Linear Prediction (CELP) codebook coding method for coding sound into first, second and third sets of encoding parameters, comprising:

producing a first Linear Prediction (LP) residual using a sound signal;

searching an adaptive codebook in response to the first LP residual to find an adaptive-codebook contribution and produce pitch parameters forming the first set of encoding parameters;

producing a second, adaptive-codebook excitation residual by subtracting the adaptive codebook contribution from the first LP residual;

pre-quantizing the second, adaptive-codebook excitation residual, the pre-quantizing comprising calculating a transform of the second, adaptive-codebook excitation residual to produce quantized transform coefficients forming the second set of encoding parameters;

producing a third excitation residual by subtracting an inverse-transformed version of the quantized transform coefficients from the adaptive-codebook contribution; and searching a CELP innovation-codebook in response to the third excitation residual to find an innovation-codebook contribution and produce innovation codebook parameters forming the third set of encoding parameters.

20. A CELP codebook coding method as defined in claim 19, wherein the transform is a Discrete Cosine Transform (DCT).

21. A CELP codebook coding method as defined in claim 19, wherein the pre-quantizing comprises calculating the transform of the second, adaptive-codebook excitation residual to produce transform coefficients, and quantizing the transform coefficients to produce the quantized transform coefficients.

22. A CELP codebook coding method as defined in claim 21, wherein quantizing the transform coefficients comprises algebraic vector quantizing said transform coefficients.

23. A CELP codebook coding method as defined in claim 21, wherein quantizing the transform coefficients comprises encoding transform coefficients related to lower frequencies only, depending on an available bit-budget.

24. A CELP codebook coding method as defined in claim 19, wherein pre-quantizing the second, adaptive-codebook excitation residual comprises pre-emphasis filtering the second, adaptive-codebook excitation residual prior to calculating the transform of the second, adaptive-codebook excitation residual.

25. A CELP codebook coding method as defined in claim 24, wherein pre-emphasis filtering comprises emphasizing low frequencies of the second, adaptive-codebook excitation residual.

26. A CELP codebook coding method as defined in claim 19, comprising calculating an inverse transform of the quantized transform coefficients, and de-emphasis filtering the inverse-transformed coefficients to produce a time-domain contribution forming the inverse-transformed version of the quantized transform coefficients, wherein producing the third excitation residual comprises subtracting the time-domain contribution from the adaptive-codebook contribution.

27. A CELP codebook coding method as defined in claim 19, wherein the CELP innovation-codebook search is an ACELP innovation-codebook search.

28. A CELP codebook coding method as defined in claim 19, wherein pre-quantizing the second, adaptive-codebook excitation residual comprises pre-quantizing only transform coefficients having an energy exceeding a specified threshold, so that spectral dynamics of the third excitation residual are reduced or maintained within a desired range.

29. A Code-Excited Linear Prediction (CELP) codebook decoding method for decoding sound in response to pitch parameters, pre-quantized coding parameters and innovation-codebook parameters, comprising:

applying the pitch parameters to an adaptive codebook structure for producing an adaptive codebook contribution;

de-quantizing the pre-quantized coding parameters into a first innovation excitation contribution, wherein de-quantizing the pre-quantized coding parameters comprises calculating an inverse transform of the coding parameters; and applying the innovation-codebook parameters to a CELP innovation-codebook structure to produce a second innovation excitation contribution;

adding the adaptive codebook contribution, the first innovation excitation contribution and the second innovation excitation contribution to form a total excitation signal; and processing the total excitation signal through a Linear Prediction (LP) synthesis filter to produce a synthesis signal representing a synthesis of said sound.

30. A CELP codebook decoding method as defined in claim 29, wherein de-quantizing the pre-quantized coding parameters comprises decoding the pre-quantized coding parameters to produce de-quantized coding parameters.

31. A CELP codebook decoding method as defined in claim 30, wherein decoding the pre-quantized coding parameters comprises Algebraic Vector Quantizer (AVQ) decoding said pre-quantized coding parameters.

32. A CELP codebook decoding method as defined in claim 29, wherein calculating an inverse transform of the coding parameters comprises calculating the inverse transform of the de-quantized coding parameters.

33. A CELP codebook decoding method as defined in claim 32, wherein the inverse transform is an inverse Discrete Cosine Transform (DCT).

34. A CELP codebook decoding method as defined in claim 32, comprising de-emphasis filtering the inverse-transformed, de-quantized coding parameters to produce the first innovation excitation contribution.

* * * * *